United States Patent [19]

Pietraszek

[11] Patent Number: 4,676,220

[45] Date of Patent: Jun. 30, 1987

[54] ARROW REST

[76] Inventor: Mitchell E. Pietraszek, 735 Saylor, Elmhurst, Ill. 60126

[21] Appl. No.: 703,030

[22] Filed: Feb. 19, 1985

[51] Int. Cl.[4] ..... F41D 10/00

[52] U.S. Cl. ..... 124/41 A

[58] Field of Search ..... 124/41 A, 24 R

[56] References Cited

U.S. PATENT DOCUMENTS

| | | | |
|---|---|---|---|
| 2,980,097 | 4/1961 | Rothgery | 124/41 A |
| 3,342,173 | 9/1967 | Ferguson | 124/41 A |
| 3,494,347 | 2/1970 | Saunders | 124/41 A |
| 4,133,334 | 1/1979 | Tone | 124/41 A |
| 4,318,390 | 3/1982 | Trotter | 124/41 A |
| 4,473,058 | 9/1984 | Terry | 124/41 A |

*Primary Examiner*—Richard C. Pinkham
*Assistant Examiner*—Benjamin Layno
*Attorney, Agent, or Firm*—Edmond T. Patnaude

[57] ABSTRACT

An arrow rest assembly for attachment to an archer's bow having a support plate. Mounted near one end of the support plate is a bowed flat spring. A magnetic rest pin is pivotally mounted to the plate for movement between an operative rest position wherein a tail section of the pin is magnetically attracted against a permanent magnet mounted to the plate and a retracted, inoperative position wherein the tail section is displaced a short distance from the magnet.

6 Claims, 11 Drawing Figures

ARROW REST

The present invention relates in general to arrow rests for attachment to archery bows for supporting an arrow during draw and release of the bow string, and it relates more particularly to a novel pivotally mounted arrow rest which is held in the operative position by a permanent magnet and which is moved out of the path of the arrow by the fletches of the arrow as they move past the arrow rest.

This is a continuation-in-part of copending application Ser. No. 456,832, filed on Feb. 25, 1983, and abandoned on July 18, 1985

BACKGROUND OF THE INVENTION

In my copending application and in U.S. Pat. No. 4,473,058, arrow rests of this basic type are shown and described. While such rests are suitable for some purposes, for use in competition it would be desirable to provide an arrow rest wherein the amount of deflection of the arrow which occurs as the fletches move past the arrow rest is substantially reduced.

SUMMARY OF THE INVENTION

Briefly, in accordance with the present invention there is provided an arrow rest assembly including a support plate having an aperture therein for receiving a fastener for attaching the plate to the side of the bow at the window portion thereof. An arrow rest formed of iron wire pivotably extends through vertically aligned openings in mounting means extending laterally from the plate, and the arrow rest has a tail portion which is magnetically attracted to a permanent magnet mounted to the face of the support plate.

In accordance with another aspect of the invention a flat spring is attached near one of its ends to the face of the support plate and is outwardly bowed to provide a resilient vertical guide surface along which the arrow moves during draw and release of the bowstring.

In another embodiment of the invention the arrow rest is formed of spring wire and has at least one reversely-bent intermediate portion which facilitates assembly of the arrow rest to the plate and which allows for the use of greater dimensional tolerences while reducing the rotational drag between the arrow rest and the mounting means in which it is journalled.

GENERAL DESCRIPTON OF THE DRAWINGS

The present invention will be better understood by a reading of the following detailed description taken in connection with the accompanying drawings wherein.

DETAILED DESCRIPTION OF PREFERRED EMBODIMENTS OF THE INVENTION

Figure 1:
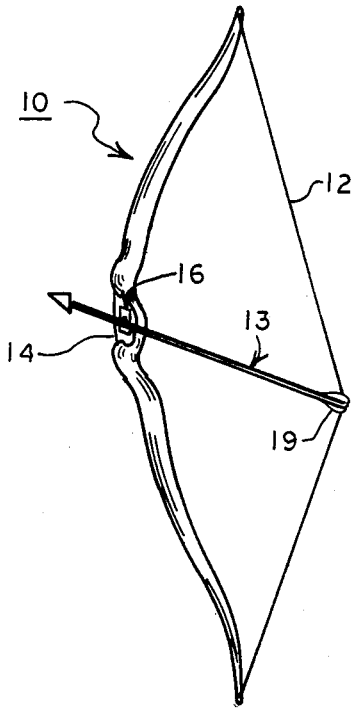
FIG. 1 is a perspective view of a bow and arrow with the arrow extending through the window of the bow and resting on an arrow rest embodying the present invention.

With particular reference to FIG. 1 of the drawings, an archer's bow 10 of conventional construction is provided with a bow string 12 for firing an arrow 13 through the window portion 14 at the center of the bow. An arrow rest assembly 16 embodies the present invention and is attached to the side of the bow at the location of the window 14 and includes a rest pin 17 as best shown, for example, in FIG. 2. As the arrow 13 is drawn back and released, the shaft of the arrow rests on the rest pin 17 which guides it in the direction of the target. As the fletches 19 of the arrow pass the rest pin 17, the rest pin 17 is deflected out of the path of travel of the fletches and the direction of flight of the arrow is only minimally disturbed, thereby providing true and accurate arrow flight as it leaves the bow.

Figure 4:
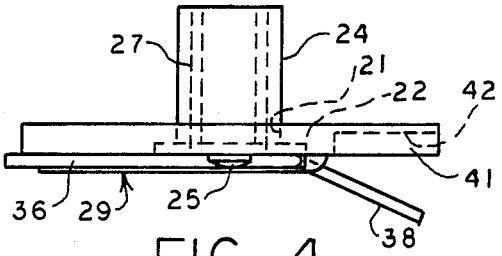
FIG. 4 is a top view of the arrow rest assembly of FIG. 2 in the retracted position.

Referring to FIGS. 2 through 6, the arrow rest assembly 16 may be seen to include a support or mounting plate 20 provided with a circular hole 21 having a counterbore 22 for receiving a tubular support 24 which is adapted to extend through a complimentary opening in the side of the bow 10. A plunger 25 is urged to its outwardmost position as shown in FIG. 4 by means of a coil spring 27 mounted within the support 24.

A rest pin mounting block 29 is secured by means of a pair of machine screws 30 to the outer face of the plate 20 and is bifurcated at its rear end by a slot 31. The upper and lower bifurcations 32 and 33 are provided on the inner faces thereof with mutually aligned, upper and lower rectangular grooves 34 and 35. The rest pin 17 is formed of magnetic wire which is circular in cross section and has a diameter which is slightly less than the depth and width of the grooves 34 and 35.

Figure 2:
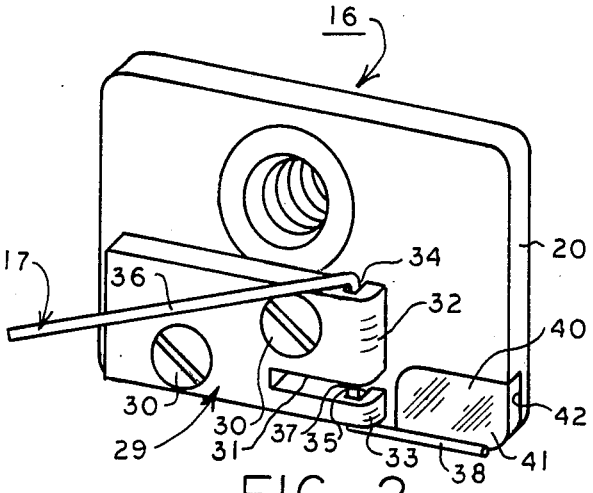
FIG. 2 is a perspective view of an arrow rest assembly embodying the present invention.
Figure 3:
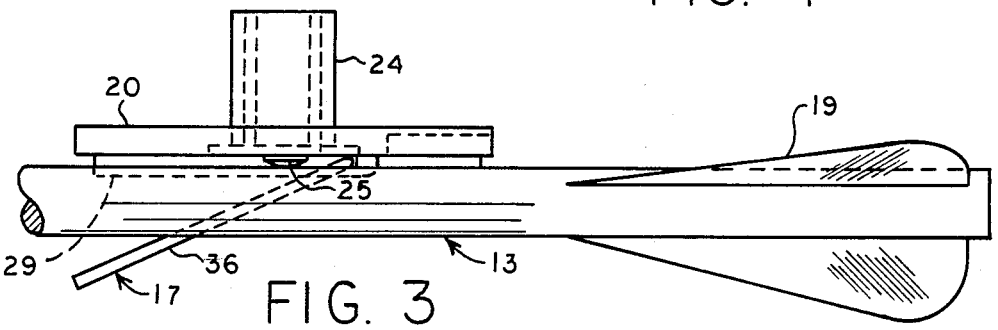
FIG. 3 is a top view of the arrow rest assembly of FIG. 2 in the extended operative position in combination with an arrow.
Figure 5:
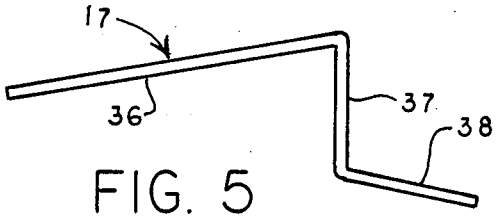
FIG. 5 is an elevational view of the rest pin of the arrow rest assembly of FIG. 1.
Figure 6:
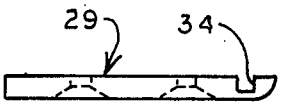
FIG. 6 is a top view of the rest pin mount of the arrow rest assembly of FIG. 1.

The rest pin 17 has a rest section 36, an intermediate section 37 which extends through the grooves 34 and 35 and a tail section 38. As best shown in FIGS. 2 and 3, when the rest pin is in the operative position wherein the rest section 36 extends into the rest position for supporting the shaft of the arrow 13, the tail section 38 lies flush against the planar surface 40 of a permanent magnet 41 mounted in a complimentary shaped recess 42 in the outer face of the plate 20. The magnetic force of attraction between the magnet and the tail piece 38 thus biases the rest pin 17 into the operative position wherein the rest section 36 extends below the shaft of the arrow 13 and points in a direction forward of the bow. Preferably, as shown in FIG. 3, the arrow rest section 36 extends at an angle of about 30 degrees relative to the plane of the mounting plate 20 when in the operative position.

It is important that the rest pin be freely rotatable in the grooves 34 and 35 so as to minimize its effect on the direction of the arrow when engaged by the fletches when the arrow is being fired. In accordance with an important feature of the present invention, the mounting block 29 is formed of a material having a very low memory such, for example, as brass, and after assembly of the unit, the position of the lower bifurcation 33 is adjusted by means of a tool such as a screw driver or pliers to minimize the rotational drag on the rest pin by suitable adjustment of the combined overall length of the passage defined by grooves 34 and 35 within which the intermediate section 37 of the rest pin 17 is disposed.

Figure 7:
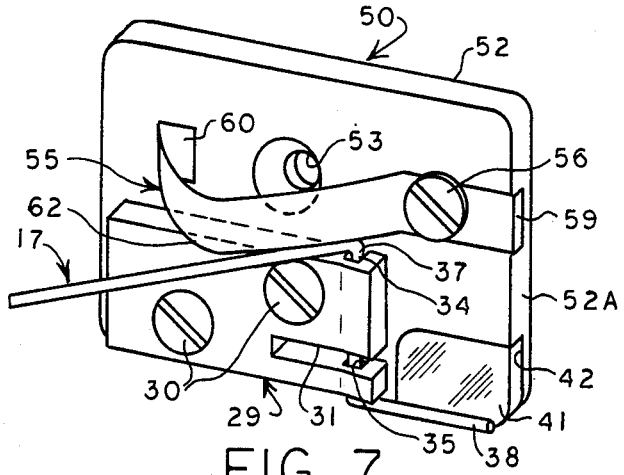
FIG. 7 is a perspective view of another arrow rest assembly embodying the present invention.

Referring to FIG. 7 there is shown an arrow rest assembly 50 which is similar in construction to the arrow rest assembly 16. The arrow rest assembly 50 includes a support or mounting plate 52 having a counter sunk hole 53 therein for receiving a mounting screw for attaching the plate 52 to a bow. The arrow rest pin mount, and the permanent magnet are the same as in the arrow rest assembly 16, and therefor, these parts have been identified in FIG. 7 with the same reference numerals used in FIG. 2. In the arrow rest assembly 50 the spring loaded plunger 25 has been replaced by the spring 55 which is attached to the outer face of the plate 52 by a machine screw 56 which extends through a hole 57 in a spring 55 and is screwed into a threaded hole (not shown) in the plate 52 with the head of the screw 56 overlying the portion of the spring 55 which surrounds the hole 57.

The spring 55 is formed of a flat strip or ribbon of spring metal and has an off-turned end 59 which lies against the side edge 52A of the plate 52. The spring 55 is provided with a generally planar off-turned portion 60 at its other end and this latter portion 60 is co-planar with the outer face of the plate 52 and is pressed against the plate 52 by the resilient force of the spring 55.

Figure 8:
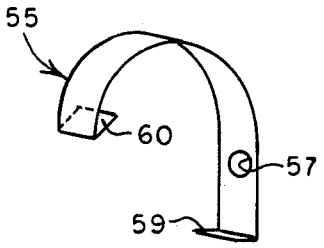
FIG. 8 is a perspective view of the guide spring of the arrow rest assembly of FIG. 7 in the unstressed condition.

As may be seen in FIG. 8, when the spring 55 is in an unstressed condition it is generally J-shaped. When, however, the spring 55 is assembled to the plate 52 as shown in FIG. 7 and the screw 56 is tightened down, the spring has an intermediate bowed portion 62 which is convex relative to the plate 52 and provides a cushion or spring guide against which the shaft of the arrow moves as the arrow is fired. The spring 55 is disposed above the path of travel of the rest pin as the rest pin moves between the retracted position out of the path of travel of the arrow and the operative position wherein it supports the arrow.

Figure 9:
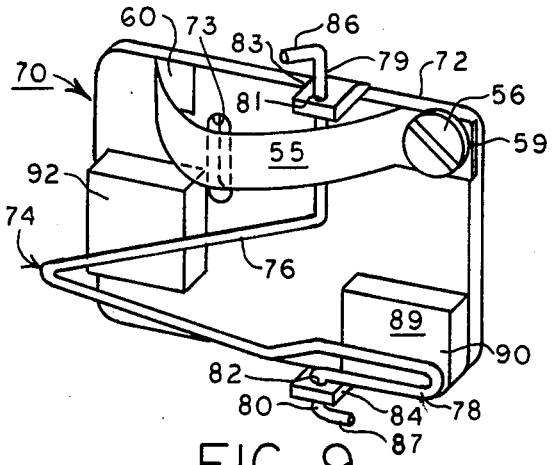
FIG. 9 is a perspective view of still another arrow rest assembly embodying the present invention.
Figure 10:
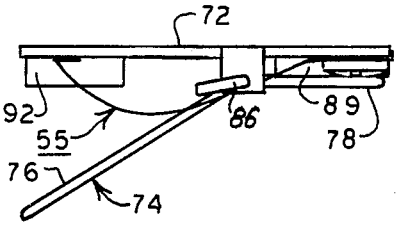
FIG. 10 is a top view of the arrow rest assembly of FIG. 9 showing the rest pin in the extended operative position.
Figure 11:
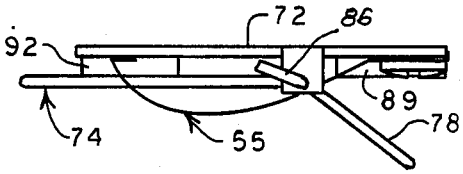
FIG. 11 is a view like that of FIG. 10 but showing the rest pin in the retracted position..

Referring to FIGS. 9, 10 and 11, there is shown another arrow rest pin assembly embodying the present invention and which is identified by the reference number 70. The arrow rest assembly 70 may be seen to include a mounting plate 72 having a vertical mounting slot 73 which enables adjustment of the vertical position of the plate 72 relative to the window of the bow to which it is mounted. The arrow rest assembly 70 includes a cushioning spring 55 which is identical to the spring 55 used in the assembly 50 of FIG. 7. It will be seen that the similar parts in the embodiments of FIGS. 7 and 9 have been identified with the same reference numbers. The arrow rest assembly 70 includes an arrow rest 74 which is formed of magnetic wire and has an intermediate bend providing an arrow rest section 76. The arrow rest 74 further includes a reversely bent tail section 78 and pivot portions 79 and 80 which extend through mutually aligned cylindrical holes 81 and 82 in a pair of integral tabs 83 and 84 which extend laterally outwardly from the plate 72. In manufacturing the assembly, the tabs are integral, bent-over portions of the plate 72. The two ends of the rest pin 74 are bent over as shown at 86 and 87 to prevent spurious disassembly of the rest pin from the plate 72.

A permanent magnet 89 is secured, as by means of cement, to the outer face of the plate 72 and has a planar outer face 90 against which the tail portion 78 lies flush when the arrow rest section 76 is in the operative position as shown in FIGS. 9 and 10. The tail section 78 is planar so as to maximize the magnetic force of attraction between the tail section and the magnet 89. A cushion member 92 formed of a soft resilient material is secured by means of cement to the outer face of the plate 72 in a position to be engaged by the rest portion 76 of the arrow rest pin as it moves from the operative to the retracted position. The cushion 92 is formed of a soft material such, for example, as a vinyl foam, and its purpose is to prevent the rest pin from striking the plate 72 and bouncing back against the fletching of the arrow before the arrow has completely cleared the window of the bow. In FIG. 10 the arrow rest pin is shown in the operative rest position. In FIG. 11 the rest pin 74 is shown in the retracted position in engagement with the cushion 92. After assembly of the arrow rest 70, the tabs 83 and 84 may be adjusted with pliers to minimize the rotational friction between the rest pin and the mounting plate 72.

While the present invention has been described in connection with particular embodiments thereof, it will be understood by those skilled in the art that many changes and modifications may be made without departing from the true spirit and scope of the present invention. Therefore, it is intended by the apended claims to cover all such changes and modifications which come within the true spirit and scope of this invention.

What is claimed:

1. An arrow rest assembly for an archer's bow, comprising in combination a support plate adapted to be mounted to the window portion of a bow with one side of said plate juxtaposed with a side surface of said bow, a block extending laterally from the opposite side of said plate and being bifurcated to provide two vertically spaced bifurcations, said bifurcations being respectively provided with axially aligned grooves opening onto the side of said block facing said support plate, a rest pin formed of magnetic wire, said rest pin extending through said grooves and having offturned end portions holding said pin in said grooves, a permanent magnet mounted to said opposite side of said plate at a position spaced from the axis defined by said grooves, said permanent magnet having a generally planar exterior surface, said rest pin having a rest portion and a tail portion, said rest portion extending from the plane of said plate at an angle of less than ninety degrees when said tail portion is juxtaposed with said planar exterior surface of said permanent magnet.

2. An arrow rest pin assembly according to claim 1 comprising a tubular member affixed to said plate and extending from said one face thereof, and a spring-loaded guide pin mounted in said tubular member and extending form said one face of said plate.

3. An arrow rest pin assembly according to claim 1, wherein said rest portion of said rest pin comprises one of said offturned end portions.

4. An arrow rest pin assembly according to claim 1, comprising a strip formed of spring material, said strip being secured near one end to said opposite side of said support plate, the end of said strip opposite said one end being free, the intermediate portion of said strip being bowed outwardly, and said free end of said strip being resiliently biased against said opposite side of said support plate.

5. An arrow rest assembly according to claim 4 wherein said strip is generally J-shaped when in an unstressed condition.

6. An arrow rest according to claim 4, wherein said free end of said strip is flat and coplanar with the surface of said plate against which it is biased.

* * * * *